US005645452A

United States Patent [19]

Kodama

[11] Patent Number: 5,645,452

[45] Date of Patent: Jul. 8, 1997

[54] CONNECTOR HOUSING

[75] Inventor: Shinji Kodama, Shizuoka, Japan

[73] Assignee: Yazaki Corporation, Tokyo, Japan

[21] Appl. No.: 489,960

[22] Filed: Jun. 13, 1995

[30] Foreign Application Priority Data

Jun. 17, 1994 [JP] Japan ..... 6-135973

[51] Int. Cl.[6] ..... H01R 13/40

[52] U.S. Cl. ..... 439/595

[58] Field of Search ..... 439/595–598

[56] References Cited

U.S. PATENT DOCUMENTS 4,329,009 5/1982 Bongo ..... 439/595

4,969,841 11/1990 Sueyoshi et al. ..... 439/595

*Primary Examiner*—Gary F. Paumen

*Assistant Examiner*—Chistopher Goins

*Attorney, Agent, or Firm*—Sughrue, Mion, Zinn, Macpeak & Seas

[57] ABSTRACT

A flexible lance for retaining a terminal inserted into a cavity is formed on a cavity floor separating adjacent cavities, formed in a connector housing, from each other. The cavity floor has a hole for receiving a front end portion of the flexible lance when this lance is flexed into a retracted position. A pair of ribs each serving as a stopper are formed on a lower surface of the cavity floor, and are disposed respectively on opposite sides of the hole, the ribs extending in a longitudinal direction. When a stress exceeding the elastic deformation limit of the lance acts on the flexible lance, side beaks are brought into engagement with the ribs, respectively, thereby preventing the flexible lance from undue displacement.

4 Claims, 6 Drawing Sheets

CONNECTOR HOUSING

BACKGROUND OF THE INVENTION

The present invention relates to a connector housing having a plurality of terminal receiving chambers, and more particularly to a connector housing of such a construction that undue displacement of a flexible lance, which would develop when releasing the retaining engagement of a connection terminal by a tool, can be prevented.

A terminal inserted into a connector housing is usually retained in a terminal receiving chamber or cavity in a double manner so as to positively prevent the terminal from slipping off from the rear of the connector housing.

In FIG. 7, a plurality of cavities 3 are formed in a connector housing la made of a synthetic resin or the like, and upper and lower cavities 3 vertically adjacent to each other are separated from each other by a partition wall (cavity floor) 5. A flexible lance 7 is provided in the cavity 3, and is integrally connected at its proximal end to the connector housing 1*a*, the other or distal end of the flexible lance 7 being free. The flexible lance 7 has a projection-like beak 9 formed at its distal end, which projects into the cavity 3.

A hole 11 for receiving the distal end of the elastically-deformed flexible lance 7 is formed through the cavity floor 5, as shown in FIGS. 8 and 9. Side beaks 13 are formed on opposite sides of the flexible lance 7, respectively, and each of these side beaks 13 has a vertical abutment surface at its front side, and a gently-slanting surface at its lower side.

A female terminal 15 to be inserted into the cavity 3 has an electrical contact portion 17 of a tubular shape formed at its front end, and a rear portion of this electrical contact portion 17 is a base portion 19. A retaining hole 21 is formed in that surface of the base portion 19 which faces the flexible lance 7, and the beak 9 is engageable in this retaining hole 21.

Retaining piece portions 23 are provided on opposite sides of the retaining hole 21, respectively, and these retaining piece portions 23 are formed by stamped-out portions produced when forming the retaining hole 21.

In this construction in which double retaining is effected by the flexible lance, when the terminal 15 is inserted into the cavity 3, the electrical contact portion 17 is brought into sliding contact with the beak 9 of the flexible lance 7, and presses the beak 9 so that the flexible lance 7 can be retracted into the hole 11 in the cavity floor 5. At this time, the side beaks 13 are displaced away from the cavity 3 beyond the retaining piece portions 23, and are held in this retracted position.

Then, when the retaining hole 21 in the terminal 15 reaches the beak 9, the flexible lance 7 is elastically restored, so that the beak 9 becomes engaged in the retaining hole 21, and also the abutment surfaces of the side beaks 13 are retained by rear edges of the retaining piece portions 23, respectively. Thus, double retaining of the terminal 15 is completed.

The terminal 15 received in the cavity 3 is often replaced by a new one, for example, because of defect or aged deterioration thereof. For effecting such replacement, a terminal removal tool 25 is inserted into the cavity 3 through an opening 27 disposed forwardly of the cavity 3 as shown in FIG. 10, and a removal operation is carried out. Then, the distal end portion of the flexible lance 7 is retracted into the hole 11 by the tool 25, thereby releasing the retaining engagement between the beak 9 and the retaining hole 21, as shown in FIG. 11.

However, if the flexible lance 7 is excessively displaced toward the hole 11 when the distal end portion of the flexible lance 7 is retracted into the hole 11, an undue stress exceeding its elastic deformation limit acts on the flexible lance 7, so that this lance may be plastically deformed. The flexible lance 7 once plastically deformed will not be restored into its original retaining position, and the retaining strength, obtained when the terminal 15 is again inserted into the cavity, is lowered. Thus, there is encountered a problem that the connector housing can not be re-used depending on the degree of deformation, which is quite uneconomical.

SUMMARY OF THE INVENTION

The present invention has been made in view of the above problem, and an object of the invention is to provide a connector housing having flexible lances each of which can be positively restored into a predetermined position even when a terminal removal tool is used, and will not be lowered in retaining strength.

The above object of the invention has been achieved by a connector housing including a plurality of terminal receiving chambers separated from each other by a partition wall; and flexible lances each having at its distal end a beak projecting into a respective one of the terminal receiving chambers, the partition wall having a hole for receiving a distal end portion of the associated flexible when the lance is flexed into a retracted position; characterized in that a stopper for engagement with a side beak formed on a side surface of the flexible lance to prevent excessive displacement of the flexible lance is formed on that portion of the partition wall disposed adjacent to the hole toward which the flexible lance is displaceable.

The above object has been achieved by the above connector housing in which the stopper is in the form of a rib extending along a length of the partition wall.

The above object has also been achieved by a connector housing including a plurality of terminal receiving chambers separated from each other by a partition wall; and flexible lances each having at its distal end a beak projecting into a respective one of the terminal receiving chambers, the partition wall having a hole for receiving a distal end portion of the associated flexible lance flexed into a retracted position; characterized in that a stopper for engagement with that portion of the partition wall disposed adjacent to the hole to prevent excessive displacement of the flexible lance, is formed on a side beak formed on a side surface of the flexible lance, the stopper being formed on that surface of the side beak displaceable toward the partition wall.

The above object has been achieved by the above connector housing in which the stopper is in the form of a projection extending in a direction of displacement of the side beak.

In the connector housing of the invention, the stopper for preventing excessive displacement of the flexible lance is formed on that portion of the partition wall disposed adjacent to the hole toward which the flexible lance is displaceable.

With this construction, even if an excessive stress exceeding its elastic deformation limit acts on the flexible lance when the distal end portion of the flexible lance is displaced toward the hole in the partition wall by a tool, the side beak is brought into engagement with the stopper, thereby preventing the flexible lance from undue displacement.

Therefore, the flexible lance will not be flexed beyond its elastic deformation limit, and will not be plastically deformed, thus preventing the retaining force from being lowered. Therefore, a good resilient force of the flexible lance is maintained.

Also, in the connector housing of the invention, the stopper for preventing undue displacement of the flexible lance is formed on the side beak formed on the side surface of the flexible lance, the stopper being formed on that surface of the side beak displaceable toward the partition wall.

With this construction, even if an excessive stress exceeding its elastic deformation limit acts on the flexible lance as in the above case, the stopper is brought into engagement with the partition wall disposed in the displacing direction, thereby preventing excessive deformation of the flexible lance.

DETAILED DESCRIPTION OF THE INVENTION

A first embodiment of a connector housing of the present invention will now be described in detail with reference to FIGS. 1 to 4.

Figure 1:
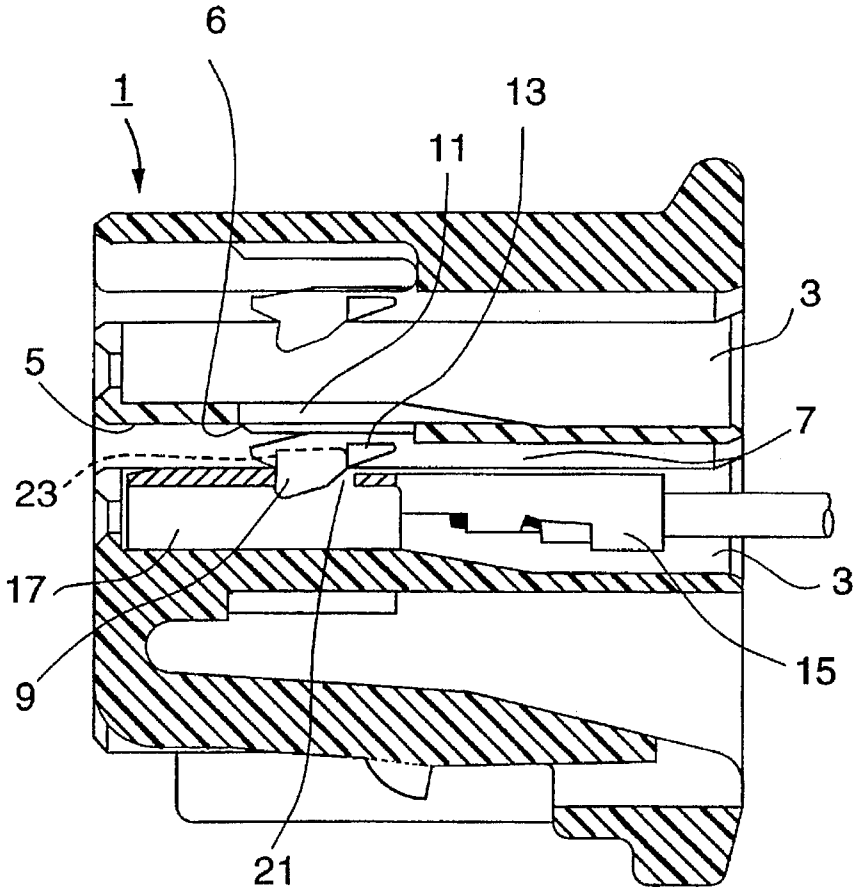
FIG. 1 is a cross-sectional view of a first embodiment of a connector housing of the invention.

As shown in FIG. 1, a flexible lance 7 is formed on a cavity floor 5 separating adjacent cavities 3 and 3 formed in a connector housing 1 from each other. The flexible lance 7 serves to retain the terminal 15 inserted into the cavity 3. A hole 11 for receiving a front end portion of the flexible lance 7 when this lance is elastically deformed into a retracted position is formed through the cavity floor 5.

A pair of ribs 6 and 6 each serving as a stopper are formed on a lower surface of the cavity floor 5, and are disposed on opposite sides of the hole 11, respectively, the ribs 6 and 6 extending in a direction of the length of the connector housing.

Such stoppers can be provided by bulging the lower surface of the cavity floor 5. Alternatively, the stopper may be formed at one of the opposite sides of the hole 11.

Figure 2:
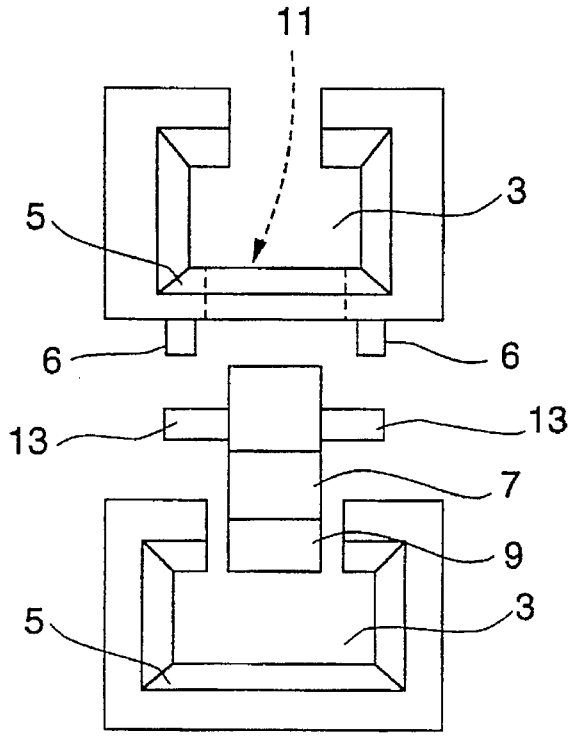
FIG. 2 is a front-elevational view of an flexible lance of FIG. 1.
Figure 3:
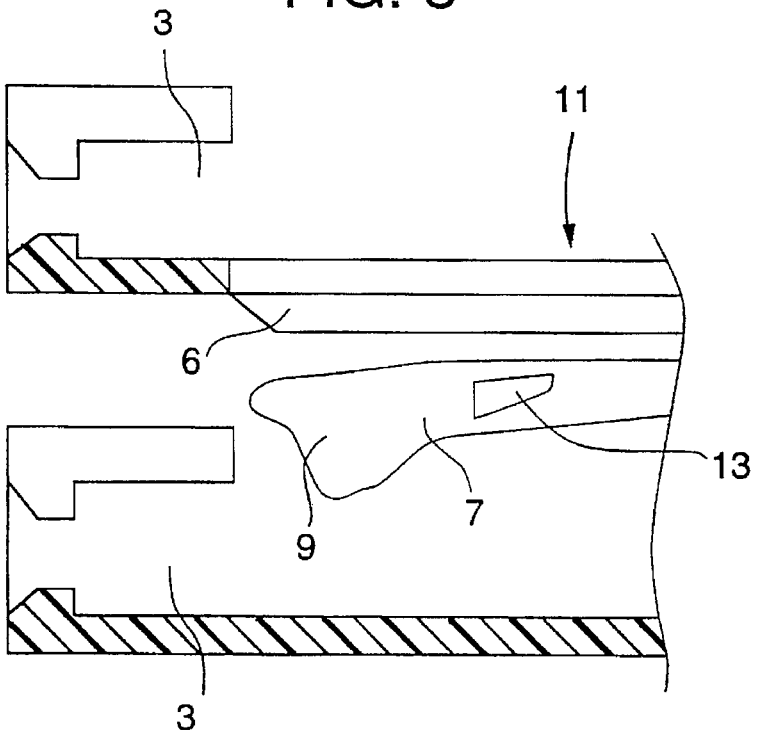
FIG. 3 is an enlarged, cross-sectional view showing an important portion of the flexible lance of FIG. 1.

As shown in FIGS. 2 and 3, when the female terminal 15 is inserted into the cavity, a beak 9 (see FIG. 1) of the flexible lance 7 is retracted into the hole 11. At this time, side beaks 13, formed respectively on opposite sides of the flexible lance 7, are displaced toward the lower surface of the cavity floor 5. Then, the side beaks 13, provided respectively on the opposite sides of the flexible lance 7, are engaged with the ribs 6, respectively.

Namely, the engagement of the side beaks 13 with the respective ribs 6 limits the flexing of the flexible lance 7 to a suitable displacement amount. Here, the term "suitable displacement amount" means a displacement amount which enables the beak 9 of the flexible lance 7 to be disengaged from a retaining hole 21 in the terminal 15, and also will not excessively flex the flexible lance 7. Therefore, the vertical dimension of the rib 6, projected from the cavity floor 5, is such that it prevents the flexible lance 7 from being displaced beyond the suitable displacement amount.

The rib 6 may be replaced by a projection or the like in so far as the upper surface of the side beak 13 can be abutted against such projection.

Figure 4:
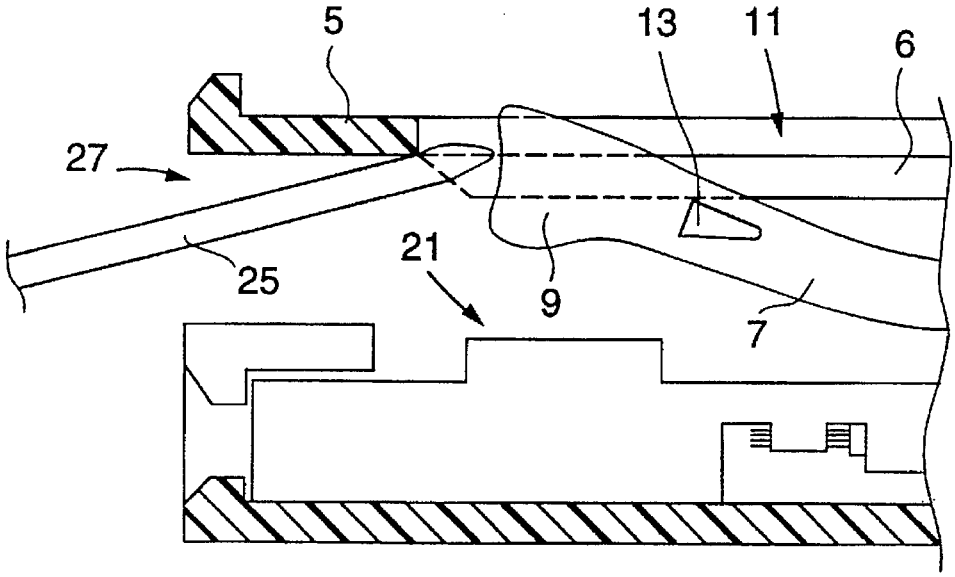
FIG. 4 is an enlarged view showing the manner of releasing the flexible lance.

The operation, effected when inserting the terminal into the connector housing will be described with reference to FIG. 1, and also the operation, effected when removing the terminal from the connector housing, will be described with reference to FIG. 4. FIG. 4 is a view of an important portion, showing the manner of releasing the flexible lance by a tool.

When the terminal 15 is inserted into the cavity 3 as shown in FIG. 1, an electrical contact portion 17 presses the beak 9 so that the flexible lance 7 is retracted into the hole 11 in the cavity floor 5. At this time, the side beaks 13 are displaced away from the cavity 3 beyond retaining piece portions 23, but are not brought into contact with the ribs 6. Then, when the terminal 15 is further inserted, the beak 9 becomes engaged in the retaining hole 21, and also front abutment surfaces of the side beaks 13 are retained by rear edges of the retaining piece portions 23, respectively, thereby achieving double retaining.

When it is necessary to remove the terminal, the tool 25 is inserted into the cavity 3 through an opening 27 disposed forwardly of the cavity 3, and the distal end portion of the cavity 7 is displaced toward the hole 11 in the cavity floor 5 by the tool 25, as shown in FIG. 4. The flexible lance 7 is thus flexed in such a manner that its distal end portion is retracted into the hole 11, and as a result the beak 9 is disengaged from the retaining hole 21, thereby releasing the retained condition of the terminal 15. At this time, even if a stress exceeding its elastic deformation limit acts on the flexible lance 7, the side beaks 13 are brought into engagement with the ribs 6, respectively, thereby preventing the flexible lance from undue displacement.

Thus, when releasing the flexible lance by the use of the tool 25, the amount of flexing of the flexible lance 7 is kept to below its elastic deformation limit, and therefore the flexible lance 7 will not be plastically deformed, and a good restoring force of the flexible lance 7 is maintained.

Figure 5:
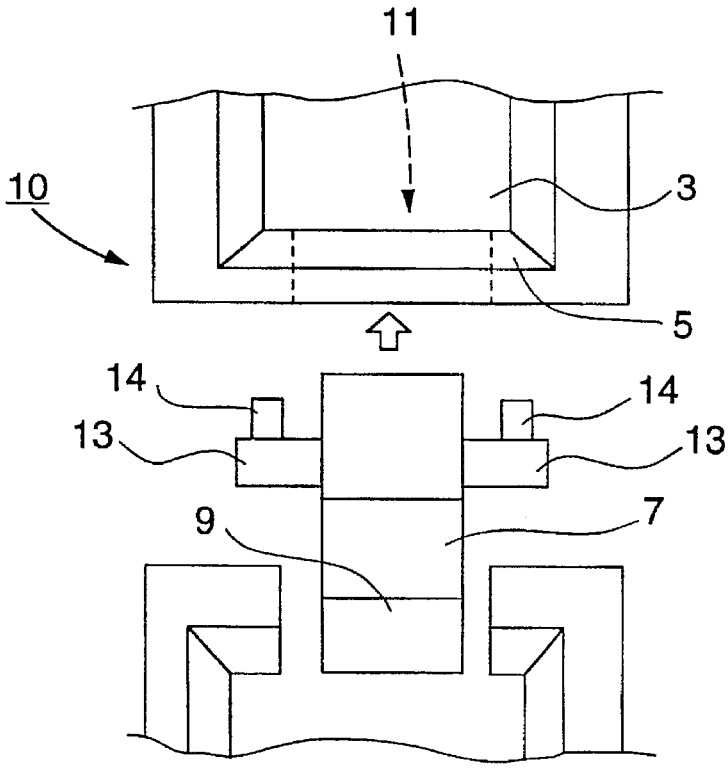
FIG. 5 is a front-elevational view showing an flexible lance of a second embodiment of the invention.

A second embodiment of a connector housing of the invention will now be described with reference to FIGS. 5 and 6. FIG. 5 is a front-elevational view of an important portion of the connector housing, and FIG. 6 is a side-elevational view of an important portion of the connector housing.

Figure 6:
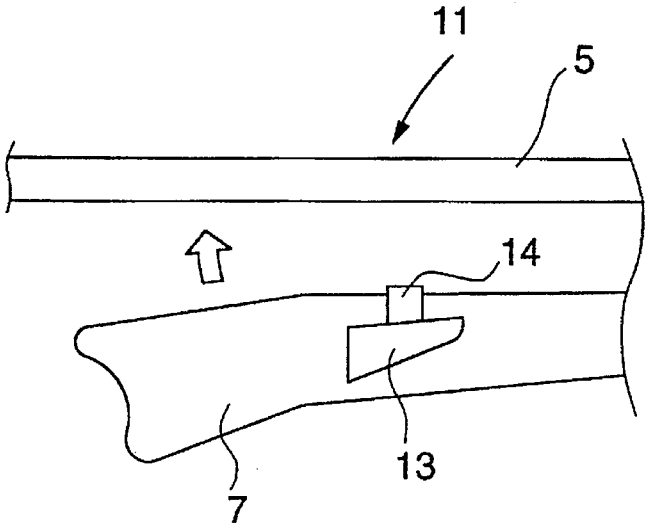
FIG. 6 is an enlarged, cross-sectional view showing the flexible lance of FIG. 5.
Figure 7:
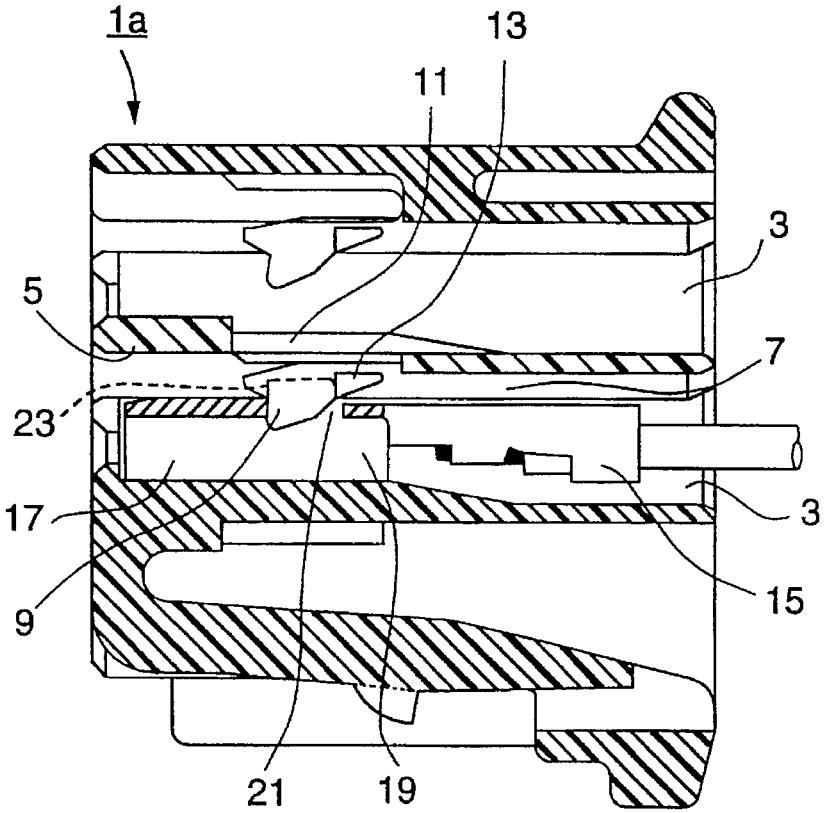
FIG. 7 PRIOR ART
FIG. 7 is a cross-sectional view of a conventional connector housing.
Figure 8:
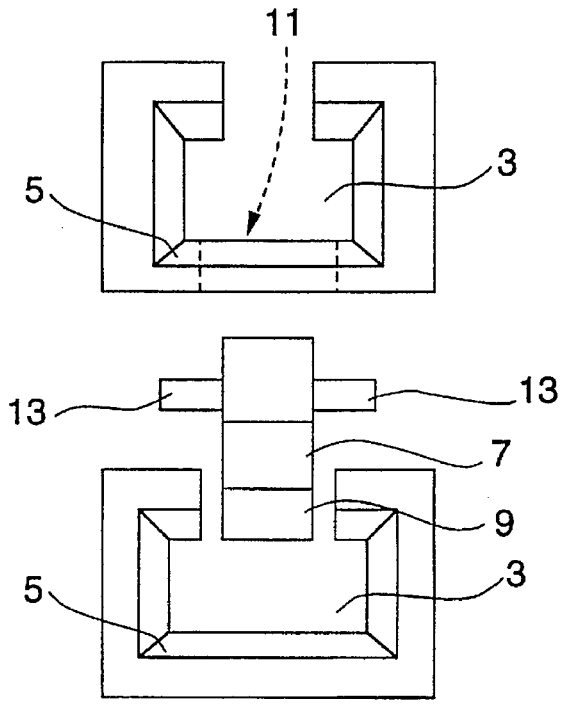
FIG. 8 PRIOR ART
FIG. 8 is a front-elevational view of a flexible lance of FIG. 7.
Figure 9:
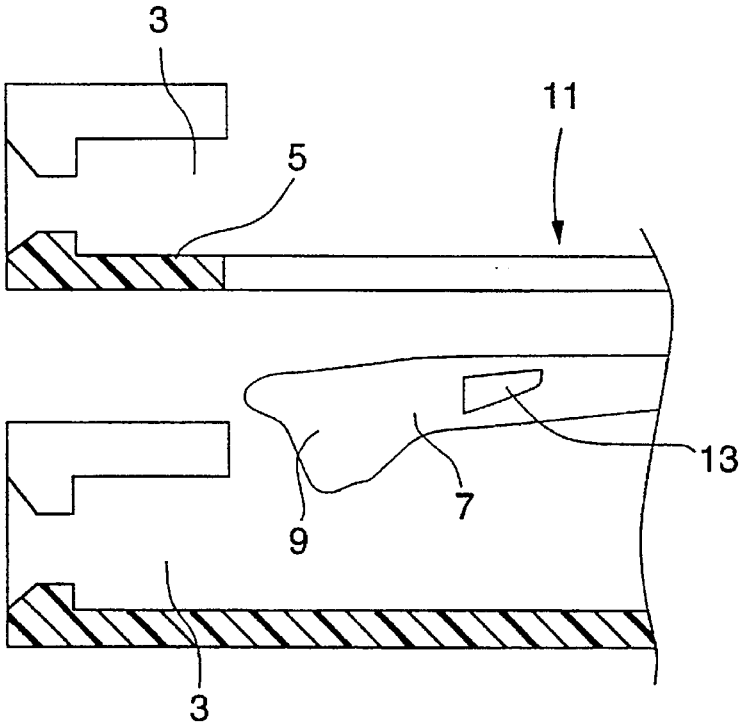
FIG. 9 PRIOR ART
FIG. 9 is an enlarged, cross-sectional view showing an important portion of the flexible lance of FIG. 7.
Figure 10:
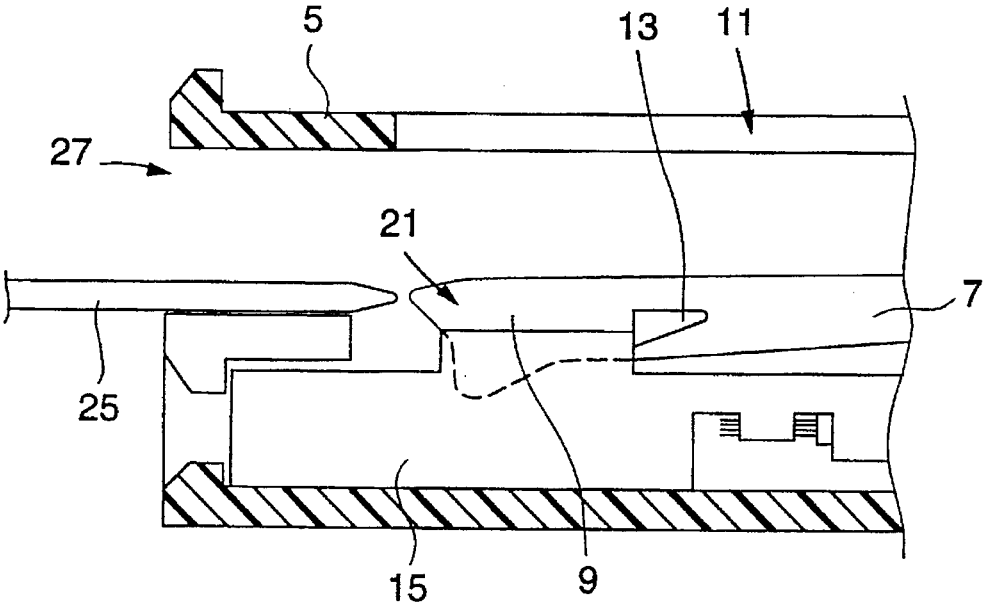
FIG. 10 PRIOR ART
FIG. 10 is a cross-sectional view showing the manner of inserting a tool for releasing the conventional flexible lance.
Figure 11:
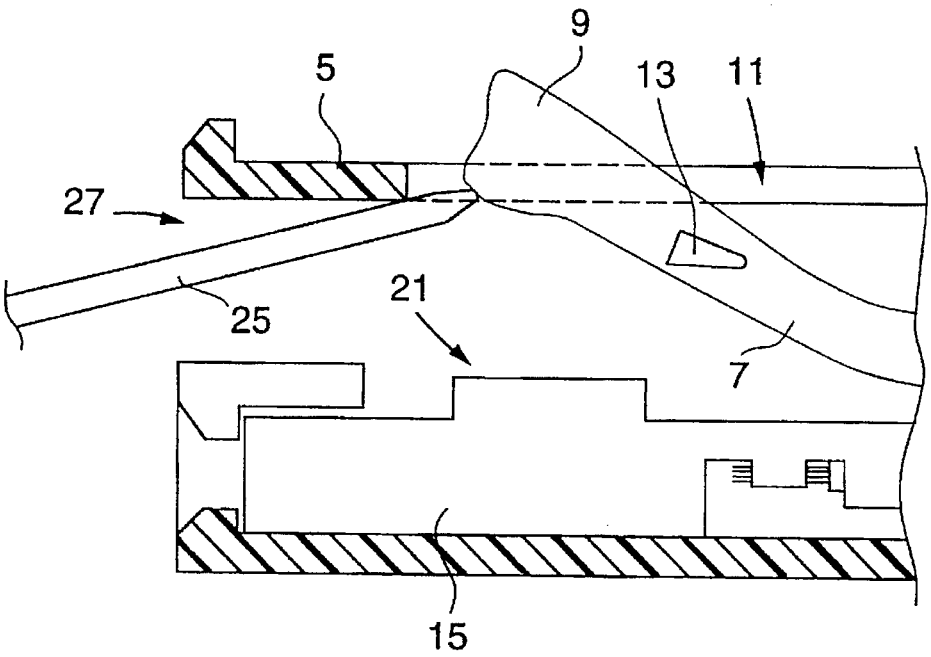
FIG. 11 PRIOR ART
FIG. 11 is a cross-sectional view showing the manner of releasing the flexible lance of FIG. 10.

As shown in FIGS. 5 and 6, projections 14 and 14 are formed respectively on upper surfaces of side beaks 13 formed respectively on opposite sides of a flexible lance 7 provided in the connector housing 10, each of the projections 14 and 14 performing the function of a stopper. When it is necessary to remove a terminal, the distal end portion of the flexible lance 7 is displaced toward a hole 11 in a cavity floor 5 by a tool.

At this time, even if a stress exceeding its elastic deformation limit acts on the flexible lance 7, the projections 14 on the side beaks 13 are brought into abutment with the lower surface of the cavity floor 5, thereby preventing the flexible lance 7 from excessive displacement.

Therefore, when releasing the flexible lance 7 by the use of the tool, the amount of flexing of the flexible lance 7 is kept to below its elastic deformation limit as in the first embodiment, and therefore the flexible lance will not be plastically deformed, and a good restoring force of the flexible lance 7 is maintained.

In the above embodiment, although the excessive displacement of the flexible lance 7 is prevented by the side beaks 13 provided for double retaining purposes, any other suitable means than the side beaks 13 may be used in so far as such means can prevent the excessive displacement of the flexible lance by abutment with the ribs 6.

In the above embodiment, although the ribs 6 are formed integrally with the cavity floor 5, there may be used rib members bonded to the cavity floor 5 of the conventional construction by an adhesive. In this case, even if the rib member may be in the form of a pin, similar effects can be achieved.

As described above, in the connector housing of first embodiment invention, the stoppers for preventing undue displacement of the flexible lance are formed on the partition wall, so that when flexible lance is to be displaced beyond its elastic deformation limit, the side beaks on the flexible lance are brought into engagement with the stoppers, respectively thereby preventing undue displacement of the flexible lance.

Therefore, the elasticity of the flexible lance will not be affected, and a good restoring force thereof is maintained, and the durability is greatly enhanced. And the reliability of the connector housing is enhanced when it is re-used, and an improved economy is achieved because the connector housing can be re-used without fail.

What is claimed is:

1. A connector housing, comprising:

a partition wall having a hole;

a plurality of terminal receiving chambers separated from each other by said partition wall;

a flexible lance having at its distal end a beak projecting into a respective one of said terminal receiving chambers, a distal end portion of said flexible lance being retractable into said hole of said partition wall;

a side beak formed on a side surface of said flexible lance; and a substantially rigid stopper for engaging with said side beak and for preventing excessive displacement of said flexible lance, said stopper being formed on a portion of said partition wall near said hole into which said flexible lance is to be displaced.

2. A connector housing according to claim 1, in which said stopper is a rib extending in a longitudinal direction of said partition wall.

3. A connector housing, comprising:

a partition wall having a hole;

a plurality of terminal receiving chambers separated from each other by said partition wall;

a flexible lance having at its distal end a beak projecting into a respective one of said terminal receiving chambers, a distal end portion of said flexible lance being retractable into said hole of said partition wall;

a side beak formed on a side surface of said flexible lance; and a substantially rigid stopper for engaging with a portion of said partition wall near said hole and for preventing excessive displacement of said flexible lance, said stopper being formed on a surface of said side beak.

4. A connector housing according to claim 3, in which said stopper is a projection extending in said direction of displacement of said side beak.

* * * * *